United States Patent [19]

Zelkowitz et al.

[11] Patent Number: 4,482,119

[45] Date of Patent: Nov. 13, 1984

[54] TABLE TOP ASSEMBLY

[75] Inventors: Hyman L. Zelkowitz, Norristown; Jeffrey D. Crawford, Whitehall, both of Pa.; Lucia Mercer, Montpelier, Vt.

[73] Assignee: Knoll International, Inc., New York, N.Y.

[21] Appl. No.: 430,722

[22] Filed: Sep. 30, 1982

[51] Int. Cl.[3] ..... F16M 11/16

[52] U.S. Cl. ..... 248/188; 108/159

[58] Field of Search ..... 248/188, 188.1, 177, 248/159; 108/159, 150; 403/245

[56] References Cited

U.S. PATENT DOCUMENTS

| | | | |
|---|---|---|---|
| 3,267,888 | 8/1966 | Carlson | 248/188 |
| 3,283,733 | 11/1966 | Boerma | 108/159 |
| 3,742,870 | 7/1973 | Gusdorf et al. | 108/150 |
| 4,243,194 | 1/1981 | Moore et al. | 248/188.1 |

*Primary Examiner*—William H. Schultz
*Assistant Examiner*—Ramon O. Ramirez
*Attorney, Agent, or Firm*—Robert Scobey

[57] ABSTRACT

A support for a table top that is positioned upon a pedestal, to prevent tilting of the table top. A pin-holding plate, secured to the underside of the table top, includes a plurality of pins attached thereto which extend downwardly and which are slidably positioned within corresponding sleeves held by a plate positioned within a recess in the top of a pedestal.

6 Claims, 3 Drawing Figures

FIG. 1.
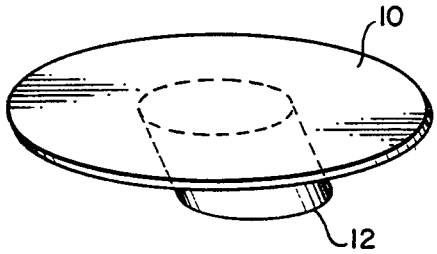
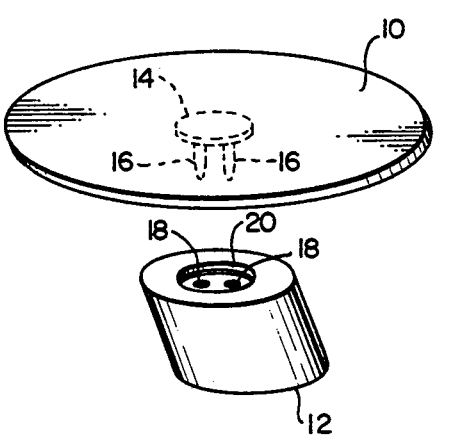
FIG. 2.
FIG. 3.
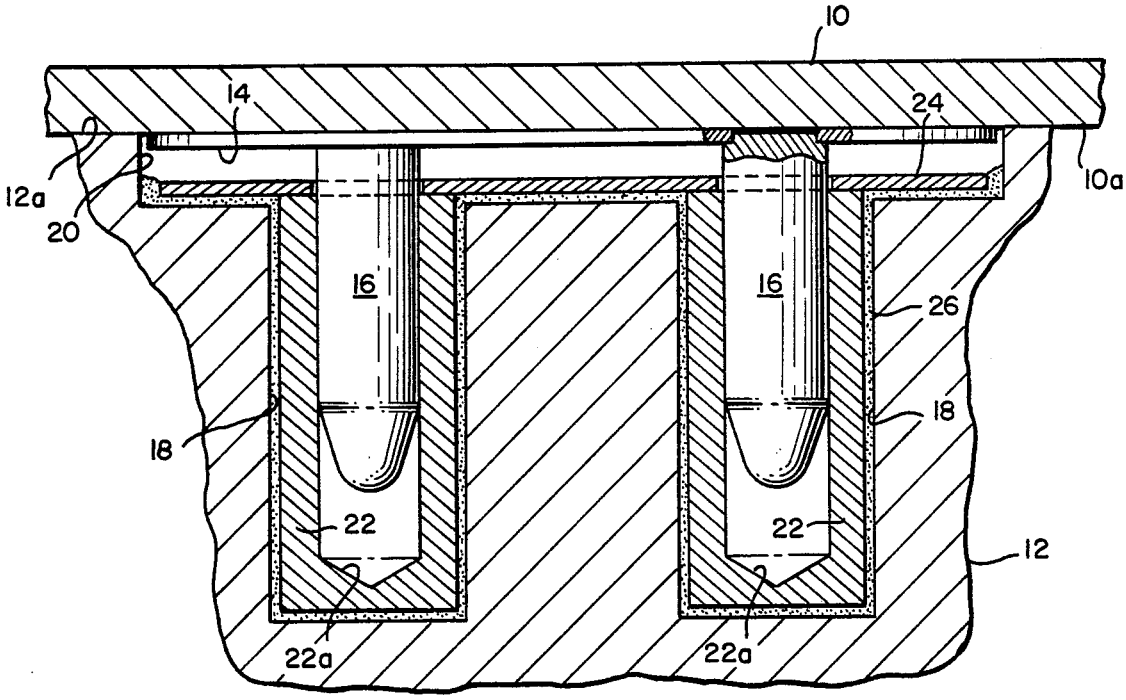

TABLE TOP ASSEMBLY

BACKGROUND AND BRIEF DESCRIPTION OF THE INVENTION

This invention relates to table top support structures, and has particular application to the supporting of a table top upon a pedestal to prevent tilting of the table top.

It is desired to support a table top upon a pedestal to prevent tilting of the table top while permitting the top to be removed, as desired. Stable table top supports are important in table structures, especially in the case of heavy table tops, which may be cantilevered from the pedestal, if supporting is to be achieved without tilting or other movement of the top.

The present invention achieves this objective by utilizing a pin structure by which the top is pinned to the pedestal, for stable, non-tilting support of the top on the pedestal, while permitting removal of the top from the pedestal.

The invention will be more clearly understood by reference to the following detailed description of a presently preferred embodiment thereof, which is to be read in conjunction with the appended drawing.

BRIEF DESCRIPTION OF THE DRAWING

FIG. 1 is a perspective view of a table embodying the invention.

FIG. 2 is an exploded view of the table of FIG. 1, showing the pinning structure for supporting the table top.

FIG. 3 is a sectional view, to an enlarged scale, of the table top pinning structure of FIG. 2.

DETAILED DESCRIPTION

Referring to FIG. 1, a table top 10 rests upon and is secured to a pedestal 12. As shown in FIG. 2, the table top 10 includes a pin-holding plate 14 secured to the underside thereof, from which pins 16 extend downwardly. The pins 16 are adapted to be slidably positioned within corresponding holes 18 within a recess 20 formed in the top surface of pedestal 12.

As shown in more detail in FIG. 3, the holes 18 formed in the pedestal 12 include sleeves 22 therein, secured to and extending downwardly from a sleeve-holding plate 24. The sleeves 22 and plate 24 are preferably secured in position by use of a glue 26 which bonds the outer surfaces of the sleeves 22 and undersurface and edge surface of sleeve-holding plate 24 to the adjacent surfaces of the holes 18 and recess 20. Additionally, the pin-holding plate 14 is preferably bonded to the table top 10 by adhesive on the underside of the table top and the upper side of the pin-holding plate.

A table top as shown in FIG. 3, with its pin-holding plate secured thereto, is positioned onto the pedestal by appropriate placement of the pins 16 within the sleeves 22. The pins are slidably received within the sleeves, with very little clearance between the two, and the table top 10 is thereby supported in stable fashion, with no tilting possible because of the engagement of pins with sleeves. Because the pins extend downwardly a significant distance, tilting of the table top is prevented. In particular, stability comes about by the use of parallel holes, together with close tolerances, thereby allowing only vertical motion and restricting any tilt when force is applied to the edge of the table.

It should be noted that the table top 10 rests on its underside 10*a* upon the upper surface 12*a* of the pedestal. Additionally, the pin-holding plate 14 is positioned within the recess 20, and is spaced vertically over the sleeve-holding plate 24. The lowermost surfaces of the pins 16 are spaced above the bottom surfaces 22*a* of the sleeves 22.

Such an arrangement has provided stable support for a table of granite, with an oval table top having axis dimensions of 50 inches and 63 inches, $1\frac{1}{2}$ inches thick, weighing approximately 354 pounds, supported upon a granite pedestal approximately $14\frac{1}{2}$ inches in diameter. Stainless steel (No. 304 stainless steel) was used as the material for the pin-holding and sleeve-holding plates, as well as pins and sleeves. The pins and sleeves were welded to their respective support plates. All weather epoxy glue was used to secure these plates and sleeves respectively to the table top and pedestal. Pins approximately 1 inch in diameter, with a tolerance of $-0.010$ inch and sleeves of internal diameter of 1 inch with a tolerance of $+0.010$ inch were employed.

It will be appreciated that the presently preferred embodiment described above is susceptible of modification. For example, an arrangement of two pins and holes has been disclosed, and is believed preferable; more are not believed required to achieve adequate stability. Tolerances would have to be very precise to accommodate more than two pins and holes. Accordingly, the invention should be taken to be defined by the following claims.

We claim:

1. A support for a table top positioned upon a pedestal comprising a pin-holding plate adapted to be secured to the underside of said table top, and a plurality of pins secured to and extending downwardly from said pin-holding plate and slidably positioned substantially entirely within corresponding holes in said pedestal, said pins being spaced from the surfaces of said holes with close tolerances therewith to permit free removal of said table top from said pedestal by vertical movement of said table top but to prevent tilting of said table top by engagement of said pins with said surfaces of said holes, said pedestal including sleeves in said holes for slidably receiving said pins, and wherein said sleeves are secured to and extend downwardly from a sleeve-holding plate.

2. A table top support as in claim 1, wherein said sleeve-holding plate is positioned within a recess in the top of said pedestal.

3. A table top support as in claim 2, wherein said pin-holding plate is also positioned within said recess.

4. A table top support as in claim 3, wherein said pin-holding plate is spaced verticaly above said sleeve-holding plate, and the underside of said table top is supported by the upper surface of said pedestal surrounding said recess.

5. A table top support as in claim 4, wherein the lowermost surfaces of said pins are spaced above the bottom surfaces of said sleeves.

6. A table top support in claim 5, wherein said pin-holding and said sleeve-holding plates and said sleeves are adhered respectively to the underside of said table top and adjacent surfaces of said recess and adjacent surfaces of said holes in said pedestal.

* * * * *